US009937733B2

(12) United States Patent
Sasaki

(10) Patent No.: US 9,937,733 B2
(45) Date of Patent: Apr. 10, 2018

(54) TRANSPORT APPARATUS AND PRINTING APPARATUS

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/441,110

(22) Filed: Feb. 23, 2017

(65) Prior Publication Data

US 2017/0246886 A1 Aug. 31, 2017

(30) Foreign Application Priority Data

Feb. 29, 2016 (JP) ..... 2016-037491

(51) Int. Cl.
*B41J 2/01* (2006.01)
*B41J 11/00* (2006.01)

(52) U.S. Cl.
CPC ..... *B41J 11/0015* (2013.01); *B41J 11/007* (2013.01)

(58) Field of Classification Search
CPC ..... B41J 13/0009; B41J 11/06; B41J 11/007; B41J 11/0015; B41J 2/155
USPC ..... 347/101, 102, 104
See application file for complete search history.

(56) References Cited

U.S. PATENT DOCUMENTS

| | | | | |
|---|---|---|---|---|
| 5,531,436 | A | 7/1996 | Ohyama et al. | |
| 8,851,659 | B2 * | 10/2014 | Shiohara | B41J 11/0015 347/101 |
| 9,283,779 | B2 * | 3/2016 | Hobo | B41J 11/0085 |
| 9,327,526 | B2 * | 5/2016 | Fletcher | B41J 13/0009 |
| 2001/0028372 | A1 | 10/2001 | Yoshimura | |
| 2009/0251522 | A1 | 10/2009 | Koike | |
| 2014/0063109 | A1 | 3/2014 | Nakamura | |
| 2014/0125750 | A1 | 5/2014 | Sasaka et al. | |

FOREIGN PATENT DOCUMENTS

| | | |
|---|---|---|
| JP | 07-137877 | 5/1995 |
| JP | 2001-277656 | 10/2001 |
| JP | 2007-145555 | 6/2007 |
| JP | 2014-047442 | 3/2014 |
| JP | 2014-091302 | 5/2014 |
| JP | 2014-098215 | 5/2014 |

OTHER PUBLICATIONS

European Search Report issued in Application No. 17157788 dated Aug. 3, 2017.

* cited by examiner

*Primary Examiner* — An Do
(74) *Attorney, Agent, or Firm* — Workman Nydegger

(57) ABSTRACT

A transport apparatus that transports a medium while heating the medium includes a transport belt that has a support surface on which a plurality of protrusions are formed, and transports the medium while attracting the medium with an intermolecular force generated between the plurality of protrusions and the medium, and a heating section for heating the medium transported by the transport belt. The plurality of protrusions are formed of a metal.

14 Claims, 4 Drawing Sheets

TRANSPORT APPARATUS AND PRINTING APPARATUS

BACKGROUND

1. Technical Field

The present invention relates to a transport apparatus that transports a medium, and a printing apparatus that performs printing on the medium transported by the transport apparatus.

2. Related Art

Hitherto, there is known a printing apparatus (ink jet recording apparatus) including a transport belt having a support surface that supports a medium such as paper, and a printing section (ink jet head) that performs printing on the medium transported by the transport belt. Further, as this type of transport belt, there is given a transport belt that has a support surface with a plurality of protrusions branched at the distal ends thereof, and attracts a medium onto the support surface with an intermolecular force generated between the plurality of protrusions and the medium (for example, JP-A-2007-145555).

The protrusions of the transport belt are formed of polymethyl methacrylate at the proximal ends and formed of carbon nanotubes at the branched distal ends for the purpose of securing flexibility and durability.

In the printing apparatus, the transported medium may be heated for the purpose of, for example, fixing a printed image or the like onto the medium. Therefore, when the protrusions of the transport belt are formed of a resin material having low heat resistance, the protrusions may thermally be deformed to reduce the intermolecular force to be generated between the plurality of protrusions and the medium. In other words, the transport accuracy of the medium may be decreased in this case.

The above-mentioned circumstances do not apply solely to the printing apparatus, but are generally common also to transport apparatuses that transport a medium while heating the medium.

SUMMARY

An advantage of some aspects of the invention is that a transport apparatus capable of suppressing a decrease in the transport accuracy of a medium even if the medium is transported while being heated is provided, and a printing apparatus including the transport apparatus is provided.

Some aspects of the invention and operations and advantages thereof are described below.

A transport apparatus according to a first aspect of the invention is a transport apparatus that transports a medium while heating the medium. The transport apparatus includes a transport belt that has a support surface on which a plurality of protrusions are formed, and transports the medium while attracting the medium with an intermolecular force generated between the plurality of protrusions and the medium, and a heating section for heating the medium transported by the transport belt. The protrusions are formed of a metal.

According to the structure described above, the plurality of protrusions formed on the support surface are formed of a metal having higher heat resistance than a resin material. Therefore, even if the transport belt is heated together with the medium, the plurality of protrusions formed on the support surface are less prone to thermal deformation, thereby suppressing the reduction in the intermolecular force to be generated between the plurality of protrusions and the medium. Accordingly, even if the medium is transported while being heated, the reduction in the attraction force of the medium on the support surface is suppressed, and hence the decrease in the transport accuracy of the medium can be suppressed.

In the transport apparatus, it is preferred that the heating section heat the transport belt.

If the medium transported by the transport belt is heated, heat transfer from the medium to the transport belt is liable to occur, with the result that the temperature of the medium is liable to decrease. In this respect, according to the structure described above, the transport belt is heated, and the medium is heated through heat transfer from the transport belt. That is, the temperature of the transport belt is higher than the temperature of the medium, and hence the heat transfer from the medium to the transport belt is suppressed. Accordingly, the temperature decrease of the medium can be suppressed.

In the transport apparatus, it is preferred that the heating section radiate infrared rays to the transport belt.

If the heating section heats the transport belt while being in contact with the transport belt, the transport belt circulating to transport the medium and the heating section may slide against each other. Therefore, smooth circulation of the transport belt may be hindered in this case, with the result that the transport accuracy may be decreased. In this respect, according to the structure described above, the heating section heats the transport belt through the radiation of the infrared rays, and hence the transport belt and the heating section need not slide against each other. Accordingly, the medium can be heated while suppressing the decrease in the transport accuracy of the medium.

In the transport apparatus, it is preferred that the heating section radiate the infrared rays to the support surface of the transport belt circulating along a path which is a part of a circulation path of the transport belt and does not constitute a transport path of the medium.

The circulation path of the transport belt includes a path which constitutes the transport path along which the medium is transported, and a path along which the medium is not transported. Therefore, focusing on a part of the support surface of the transport belt, the part of the support surface is alternately switched between a state in which the medium is supported and a state in which the medium is not supported. According to the structure described above, the infrared rays are radiated to the support surface of the transport belt circulating along the path which does not constitute the transport path, and hence the support surface which subsequently supports the medium can be heated. Accordingly, the medium to be supported by the support surface can be heated efficiently.

It is preferred that the transport apparatus further include a plurality of belt rollers around which the transport belt is looped, and that the transport belt have slits extending along a width direction of the transport belt, which intersects with a circulation direction of the transport belt, and being formed through the transport belt with intervals secured in the circulation direction.

For example, when the transport belt is per se formed of the same metal as that of the protrusions, the rigidity of the transport belt is increased, and hence the transport belt is not easily curved in the circulation direction. Therefore, the transport belt does not circulate smoothly at a part where the transport belt is looped around the plurality of belt rollers, with the result that the transport accuracy of the medium may be decreased.

In this respect, according to the structure described above, the plurality of slits extending along the width direction are formed in the transport belt along the circulation direction, and hence the transport belt is easily curved in the circulation direction. Accordingly, the transport belt smoothly circulates with ease at the part where the transport belt is looped around the plurality of belt rollers, and hence the decrease in the transport accuracy of the medium can be suppressed.

It is preferred that the transport apparatus further include a suction mechanism that is arranged so as to face a transport path of the medium across the transport belt, and sucks gas via the slits.

According to the structure described above, gas is sucked via the slits formed through the support surface, and hence the medium transported along the transport path is sucked/attracted onto the support surface. Therefore, the medium is not easily separated from the support surface compared to a case where the medium is attracted only with the intermolecular force exerted between the plurality of protrusions and the medium. Accordingly, the medium can be transported in a more stable posture.

It is preferred that the transport apparatus further include a wiping section that wipes the support surface of the transport belt circulating along a path which is a part of a circulation path of the transport belt and does not constitute a transport path of the medium, and that the wiping section be formed of a material having a lower elastic modulus than a material for the plurality of protrusions.

According to the structure described above, the wiping section wipes the support surface of the transport belt, thereby being capable of reducing the occurrence of a case in which the medium is attracted onto the transport belt to which soil adheres. Further, the wiping section is formed of a material having a lower elastic modulus than the material for the protrusions, thereby being capable of reducing the occurrence of a case in which the plurality of protrusions are deformed when the support surface is wiped.

A printing apparatus according to a second aspect of the invention includes the transport apparatus described above, and a printing section that performs printing on the medium transported by the transport belt of the transport apparatus.

According to the structure described above, the operations and advantages described above can be attained in the printing apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

A printing apparatus including a transport apparatus according to an embodiment of the invention is described below. The printing apparatus of this embodiment is an ink jet printer that performs printing (textile printing) on a medium such as a textile by ejecting ink.

Figure 1:
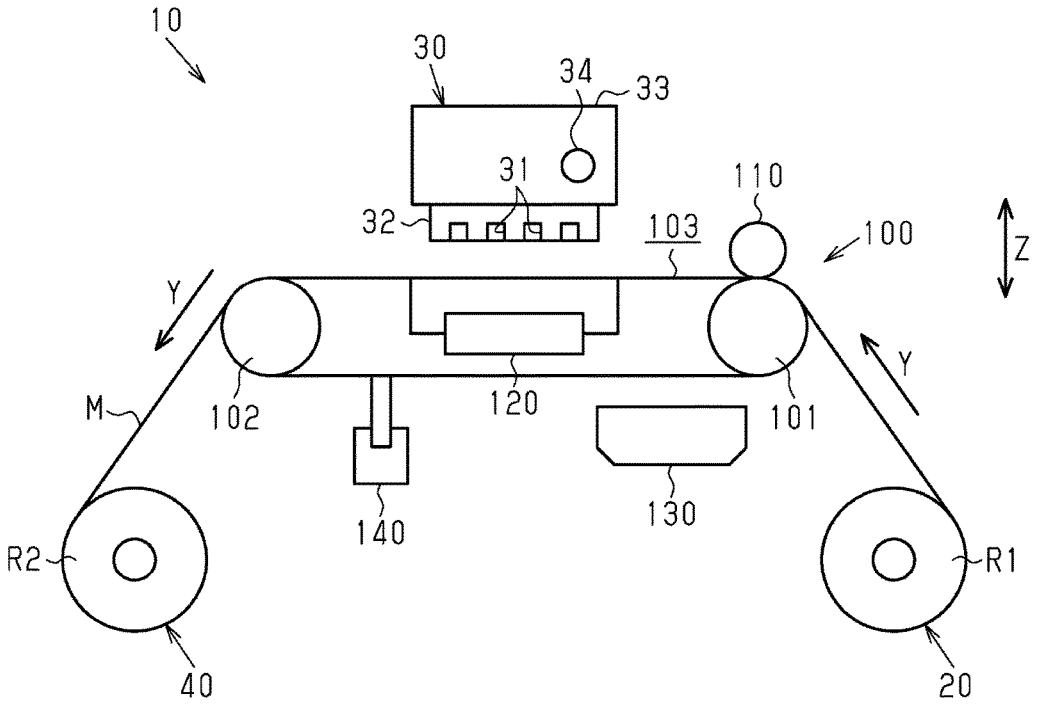
FIG. 1 is a side view illustrating the schematic structure of a printing apparatus.

As illustrated in FIG. 1, a printing apparatus 10 includes a feeding section 20 that feeds a medium M wound up into a roll shape, a transport apparatus 100 that transports the medium M, a printing section 30 that performs printing on the transported medium M, and a take-up section 40 that takes up the medium M subjected to the printing.

As illustrated in FIG. 1, the feeding section 20 supports a roll R1, around which the medium M is wound up, so that the axial direction of the roll R1 coincides with a "width direction X (see FIG. 3)" of the printing apparatus 10. Further, the feeding section 20 feeds the medium M in a "transport direction Y" by rotating the roll R1 in one direction (in FIG. 1, a counterclockwise direction). In FIG. 1, the width direction X is a direction orthogonal to the drawing sheet.

The printing section 30 includes an ejecting portion 32 having nozzles 31 that eject ink, a carriage 33 that supports the ejecting portion 32 so that the nozzles 31 are oriented toward a transport path of the medium M, and a guide shaft 34 that supports the carriage 33 so that the carriage 33 is movable in the width direction X. The ejecting portion 32 is a so-called ink jet head. The carriage 33 is connected to a drive mechanism (not shown), and moves toward one end side in the width direction X and toward the other end side in the width direction X along with driving of the drive mechanism. The printing section 30 performs printing for one pass by performing an "ejecting operation" for ejecting ink toward the medium M from the nozzles 31 of the ejecting portion 32 while moving the carriage 33 in the width direction X.

The take-up section 40 supports a roll R2, around which the medium M is wound up, so that the axial direction of the roll R2 coincides with the width direction X. Further, the take-up section 40 takes up the medium M subjected to the printing by rotating the roll R2 in one direction (in FIG. 1, a counterclockwise direction).

Next, the transport apparatus 100 is described in detail with reference to FIG. 2. Note that the transport apparatus 100 of this embodiment is a transport apparatus that transports the medium M while heating the medium M.

Figure 2:
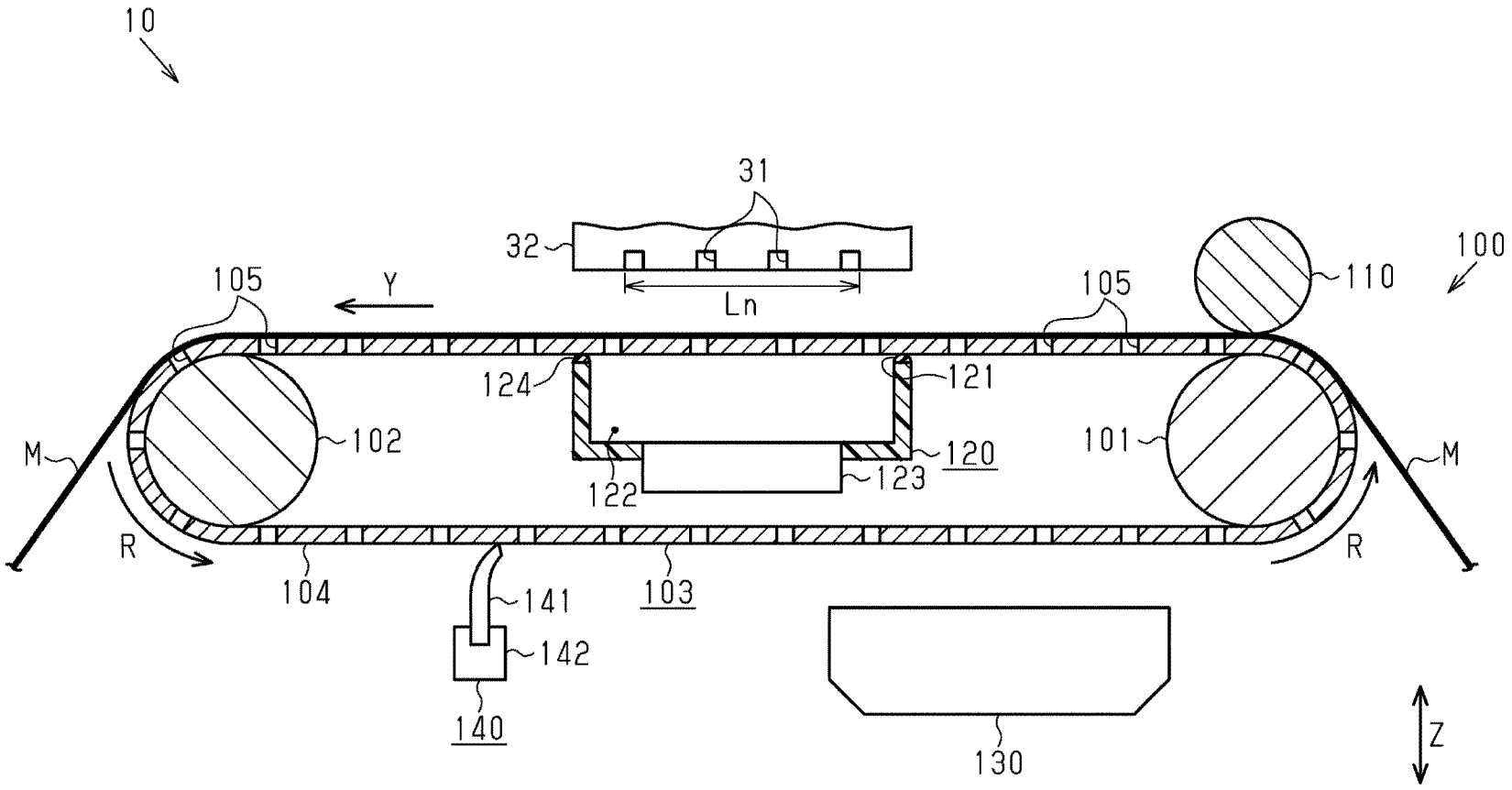
FIG. 2 is a side view illustrating the schematic structure of a transport apparatus provided to the printing apparatus.

As illustrated in FIG. 2, the transport apparatus 100 includes a first belt roller 101 arranged on an upstream side in the transport direction with respect to the ejecting portion 32, a second belt roller 102 arranged on a downstream side in the transport direction with respect to the ejecting portion 32, and an endless transport belt 103 looped around the first belt roller 101 and the second belt roller 102. Further, the transport apparatus 100 includes a pressing roller 110 that presses the medium M against the transport belt 103, a suction mechanism 120 for attracting the medium M onto the transport belt 103, a heating section 130 that heats the transport belt 103, and a wiping section 140 that wipes the transport belt 103.

As illustrated in FIG. 2, the first belt roller 101 and the second belt roller 102 are supported so as to be rotatable with the width direction X set as the axial directions thereof. The first belt roller 101 is a roller that is rotationally drivable by being coupled to a drive source such as a motor, and the second belt roller 102 is a roller that is rotationally undrivable. Further, the second belt roller 102 is urged in a direction in which a tensile force is applied to the transport belt 103 (for example, in the transport direction Y). With this structure, the first belt roller 101 and the second belt roller 102 support the transport belt 103 so as to prevent slacking in the transport belt 103.

Figure 3:
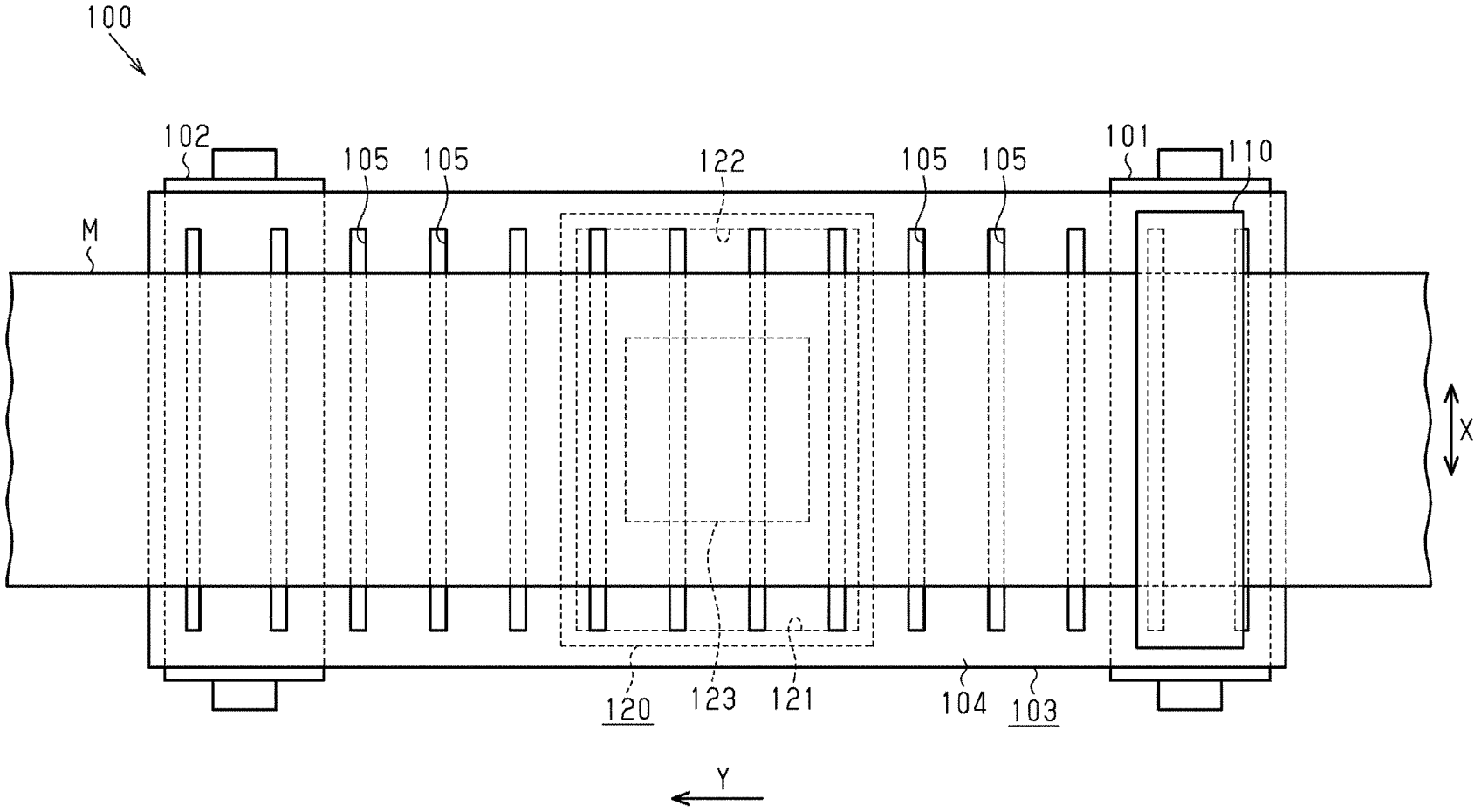
FIG. 3 is a plan view illustrating the schematic structure of the transport apparatus.

As illustrated in FIG. 2 and FIG. 3, the outer surface of the transport belt 103 is a support surface 104 that supports the medium M. A plurality of slits 105 extending along the width direction X intersecting with a circulation direction R of the transport belt 103 are formed in the transport belt 103 with intervals secured in the circulation direction R. The slit 105 is formed through the transport belt 103 so as to enable the support surface 104 and the inner surface of the transport belt 103 to communicate with each other. Further, the length of the slit 105 is larger in the width direction X than the lengths of all the media M on which printing is to be performed by the printing apparatus 10.

Figure 4:
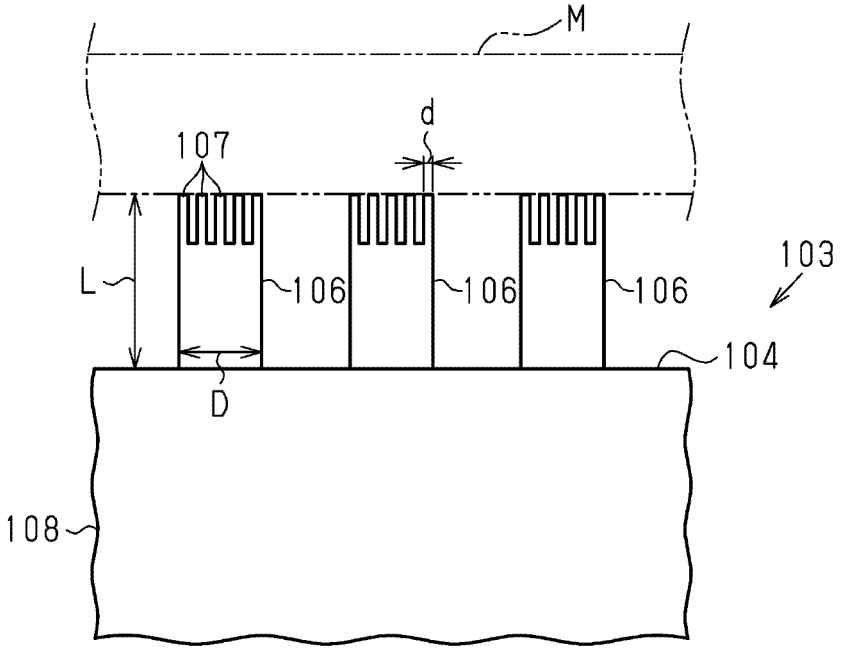
FIG. 4 is an enlarged view of a support surface of a transport belt provided to the transport apparatus.

Further, as illustrated in FIG. 4, a plurality of protrusions 106 branched at the distal ends thereof are formed on the support surface 104 of the transport belt 103. Specifically, at the distal end of one protrusion 106, a plurality of minute protrusions 107 smaller than the protrusion 106 are formed. The plurality of protrusions 106 are structures for generating an intermolecular force between the plurality of protrusions 106 and the medium M when the support surface 104 supports the medium M. In this embodiment, the situation in which the medium M is attracted (supported) by the distal ends of the minute protrusions 107 is also described as "the medium M is attracted (supported) by the support surface 104".

As one example, it is appropriate to set a length L of the protrusion 106 to 100 to 200 μm, set a diameter D of the protrusion 106 to 10 μm, set a diameter d of the minute protrusion 107 to 0.1 to 0.2 μm, and form one or more minute protrusions 107 per square micrometer. Further, it is appropriate to set a thickness of a base portion 108 of the transport belt 103 to 300 to 500 μm. That is, the thickness of the transport belt 103 is a sum of the length L of the protrusion 106 and the thickness of the base portion 108. Note that those numerical values are only an example, and may be changed as appropriate depending on the intermolecular force that is necessary to attract, onto the support surface 104, the medium M on which printing is to be performed.

Further, in this embodiment, the protrusions 106, the minute protrusions 107, and the base portion 108 of the transport belt 103 are formed of the same material. Therefore, in this embodiment, the transport belt 103 is manufactured through the following steps. That is, the transport belt 103 is manufactured through the steps including a first step (molding step) for molding a plate material into a belt shape having predetermined dimensions, and a second step (punching step) for forming the slits 105 in the plate material that is molded into the belt shape. Further, the transport belt 103 is manufactured through the steps including a third step (transferring step) for forming the plurality of protrusions 106 and minute protrusions 107 on the plate material having the slits 105 formed therein, and a fourth step (coupling step) for coupling the ends of the plate material of the belt shape into an endless belt.

In the third step, it is appropriate to form the plurality of protrusions 106 having the plurality of minute protrusions 107 by using a known nanoimprint technology. Specifically, it is appropriate to form the plurality of protrusions 106 and minute protrusions 107 by pressing, against a heated plate material, a mold having pits and bumps formed therein. As a method for pressing the mold against the plate material, a press machine may be used to press the mold against the plate material, or air may be sucked from a gap between the mold and the plate material to attract the mold onto the plate material in a vacuum.

It is desired that the material for the transport belt 103 have a melting point of 800° C. or less from the viewpoint of securing the moldability in the manufacturing steps described above, and also have a melting point of 400° C. or more from the viewpoint of heating the transport belt 103. Thus, it is desired that the material for the transport belt 103 be a metal such as magnesium, aluminum, a magnesium alloy, or an aluminum alloy, or metallic glass (amorphous metal) that satisfies the conditions described above.

As illustrated in FIG. 2, the pressing roller 110 is arranged so as to face, in a vertical direction Z, the first belt roller 101 across the transport path of the medium M. The axial direction of the pressing roller 110 is set so as to coincide with the width direction X, and the length of the pressing roller 110 is set larger in the width direction X than the length of the slit 105 of the transport belt 103. Further, the pressing roller 110 presses the medium M toward the transport belt 103 to bring the medium M into contact with the support surface 104, thereby generating an intermolecular force between the plurality of protrusions 106 formed on the support surface 104 and the medium M.

As illustrated in FIG. 2 and FIG. 3, the suction mechanism 120 is arranged so as to face the transport path of the medium M across the transport belt 103. Specifically, the suction mechanism 120 is arranged so as to face the ejecting portion 32 across the transport belt 103 and the transport path of the medium M. Further, the suction mechanism 120 includes a negative pressure chamber 122 having an opening 121 toward the transport path, and a suction section 123 that sucks gas inside the negative pressure chamber 122.

It is preferred that, in the transport direction Y, the length of the opening 121 of the negative pressure chamber 122 be larger than a length Ln of a nozzle array of the ejecting portion 32. Further, it is preferred that, in the width direction X, the length of the opening 121 of the negative pressure chamber 122 be substantially equal to the length of the slit 105 formed in the transport belt 103. That is, the negative pressure chamber 122 communicates with a space between the ejecting portion 32 and the transport belt 103 via the slits 105 of the transport belt 103.

In the negative pressure chamber 122, the open edge of the opening 121 is a sliding portion 124 that slides against the back surface of the transport belt 103. It is preferred that the sliding portion 124 be formed of a material that has low gas permeability and is elastically deformable in response to the sliding against the transport belt 103. Further, the sliding portion 124 suppresses an inflow of gas into the negative pressure chamber 122 through a gap between the back surface of the transport belt 103 and the negative pressure chamber 122 (sliding portion 124) while suppressing an increase in the rotational load of the transport belt 103 due to the sliding against the transport belt 103. It is appropriate that the suction section 123 be a suction pump such as a tube pump.

With this structure, the suction mechanism 120 reduces the pressure inside the negative pressure chamber 122 by sucking gas inside the negative pressure chamber 122 through driving of the suction section 123. Then, gas flows into the negative pressure chamber 122 via the slits 105 of the transport belt 103, thereby exerting a suction/attraction force for attracting the medium M onto the support surface 104. Note that the suction/attraction force is exerted on a part of the support surface 104 where the slits 105 which communicate with the negative pressure chamber 122 are formed, and hence the suction/attraction force is not exerted on the support surface 104 of the transport belt 103 which is located on an upstream side in the transport direction with respect to the negative pressure chamber 122, or on the support surface 104 of the transport belt 103 which is located on a downstream side in the transport direction with respect to the negative pressure chamber 122.

As described above, the transport belt 103 of the transport apparatus 100 attracts the medium M onto the support surface 104 with the intermolecular force exerted between the plurality of protrusions 106 and the medium M. Further, at the part facing the ejecting portion 32, the medium M is attracted onto the support surface 104 more forcefully with the suction/attraction force exerted via the slits 105 which communicate with the negative pressure chamber 122. Then, the transport belt 103 is caused to circulate counterclockwise in FIG. 2 through the driving of the first belt roller 101, and hence the medium M attracted onto the support surface 104 is transported in the transport direction Y.

In the following description, the transport of the medium M with the transport belt 103 by a unit transport amount in the transport direction Y is also referred to as "transport operation". In this case, it is preferred that the unit transport amount be equal to or less than the length Ln of the nozzle array of the ejecting portion 32.

As illustrated in FIG. 2, the heating section 130 radiates infrared rays toward the support surface 104 of the transport belt 103 at a position vertically below the transport belt 103. Specifically, the heating section 130 of this embodiment heats, without being brought into contact with the support surface 104, the support surface 104 of the transport belt 103 circulating along a path which is a part of the circulation path of the transport belt 103 and does not constitute the transport path of the medium M. It is appropriate that the infrared rays be electromagnetic waves having a wavelength of about 0.7 μm to about 1000 μm.

Note that, in this embodiment, the plurality of protrusions 106 branched at the distal ends thereof are formed on the support surface 104 for the medium M, and hence the surface area of the support surface 104 is larger than in a case where the support surface 104 is made smooth without forming the protrusions 106. Therefore, the absorbance of the infrared rays radiated toward the support surface 104 is increased, and hence the heating efficiency of the support surface 104 is increased. In order to further increase the absorbance of the infrared rays for the support surface 104, the support surface 104 may be tinted with colors having high absorbance (for example, black) or subjected to anodization if possible.

With this structure, the heating section 130 heats the support surface 104 by radiating the infrared rays to the support surface 104 before the medium M is supported thereon. After that, the heated support surface 104 supports the medium M along with the circulation of the transport belt 103, and hence the medium M is heated through heat transfer from the support surface 104 to the medium M. In this embodiment, the path which is a part of the circulation path of the transport belt 103 and constitutes the transport path extends over a range from the upstream side in the transport direction with respect to the ejecting portion 32 to the downstream side in the transport direction with respect to the ejecting portion 32, and hence the medium M is heated before, during, and after the printing.

Further, in this embodiment, the transport belt 103 is formed of a metal having high thermal conductivity, and a part of the transport belt 103 is heated by the heating section 130. Therefore, the temperature of the transport belt 103 is easily kept high per se. Thus, it is possible to suppress a temperature decrease at a part of the transport belt 103 which is in contact with the medium M due to the heat transfer to the medium M.

It is appropriate that the method for driving the heating section 130 and the target temperature of the transport belt 103 to be heated be determined on the basis of the properties of the ink to be ejected onto the medium M and the properties of the medium M. For example, it is appropriate that the driving method and the target temperature be determined on the basis of the boiling point of a solvent component of the ink and, when a resin to be melted is contained in the ink, on the basis of the melting point of the resin.

As illustrated in FIG. 2, the wiping section 140 is arranged vertically below the transport belt 103 so as to be oriented toward the transport belt 103. Further, the wiping section 140 is arranged between the suction mechanism 120 and the heating section 130 in the circulation direction R of the transport belt 103.

The wiping section 140 includes a wiper 141 that is in contact with the support surface 104 of the transport belt 103, and a wiper support 142 that supports the wiper 141. The wiper 141 is formed of a material that is capable of absorbing liquid and has a lower elastic modulus than the material that forms the protrusions 106 of the transport belt 103. Further, the wiper 141 may be a fabric wiper formed of a textile such as a fabric that is capable of absorbing liquid, or may be a wiper blade or a brush formed of a rubber material or a resin material that is incapable of absorbing liquid.

The wiper support 142 supports the wiper 141 so that the wiper 141 is in contact with the support surface 104 of the circulating transport belt 103. Further, the wiper support 142 may be configured to ascend/descend relative to the transport belt 103 so as to be capable of changing the contact pressure of the wiper 141 that is applied to the support surface 104.

When the transport belt 103 transports the medium M, the wiping section 140 slides against the support surface 104 of the transport belt 103 circulating along the path which is a part of the circulation path of the transport belt 103 and does not constitute the transport path of the medium M, thereby removing the ink and dust of the medium M (paper dust) that adhere to the transport belt 103.

Next, operations of the printing apparatus 10 of this embodiment are described.

As illustrated in FIG. 1, in the printing apparatus 10 of this embodiment, the user of the printing apparatus 10 sets the medium M before the start of printing. Specifically, the medium M wound up around the roll R1 of the feeding section 20 is drawn out so as to pass through the transport path on the transport belt 103, and is wound up around the roll R2 of the take-up section 40. When the medium M is thus set on the printing apparatus 10, the roll R1 of the feeding section 20, the transport belt 103 of the transport apparatus 100, and the roll R2 of the take-up section 40 are rotationally driven to start transporting the medium M in the transport direction Y.

When the medium M thus fed from the feeding section 20 has reached an upstream side in the transport direction on the transport apparatus 100, the medium M is pressed against the transport belt 103 by the pressing roller 110. In this case, the transport belt 103 of the transport apparatus 100 has, on the support surface 104, the plurality of protrusions 106 branched at the distal ends thereof, and hence the medium M is attracted onto the support surface 104 with an intermolecular force generated between the plurality of protrusions 106 and the medium M.

When the medium M is then transported to a position where the medium M faces the negative pressure chamber 122 across the transport belt 103, the slits 105 formed in the transport belt 103 communicate with the negative pressure chamber 122, and hence a suction/attraction force is generated on the support surface 104. Therefore, a part of the medium M which is transported by the transport belt 103 and subjected to the printing by the printing section 30 is attracted onto the support surface 104 more forcefully with both the intermolecular force and the suction force. Thus, the printing section 30 can eject the ink toward the medium M that takes a stable posture, thereby suppressing a decrease in the print quality that may be caused by, for example, separation of the medium M from the support surface 104.

When the medium M subjected to the printing is then transported to a position where the medium M does not face the negative pressure chamber 122 across the transport belt 103, the slits 105 formed in the transport belt 103 do not communicate with the negative pressure chamber 122, and hence the suction/attraction force is not exerted on the support surface 104. When the medium M is then transported to a position where the medium M faces the second belt roller 102 across the transport belt 103, the medium M is released from the transport belt 103, and is taken up by the take-up section 40. In this manner, the printing is performed on the medium M fed from the feeding section 20.

The support surface 104 of the transport belt 103 that has finished transporting the medium M is wiped by sliding against the wiping section 140 when circulating along the path which is a part of the circulation path of the transport belt 103 and does not constitute the transport path of the medium M. Then, the support surface 104 wiped by the wiping section 140 supports the medium M again by circulating along the path which is a part of the circulation path of the transport belt 103 and constitutes the transport path of the medium M. Even if foreign substances such as the ink and fragments of the medium M (paper dust) adhere to the support surface 104 of the transport belt 103 as a result of performing the printing and transporting the medium M, the wiping operation suppresses the risk of supporting the medium M on the support surface 104 to which the foreign substances are still adhering.

Further, in this embodiment, the transport belt 103 is heated by receiving the infrared rays radiated from the heating section 130 to the support surface 104 before the medium M is supported. Therefore, the medium M attracted onto the support surface 104 is heated through heat transfer from the transport belt 103, and hence the solvent component of the ink ejected onto the medium M is evaporated.

According to the embodiment described above, the following advantages can be attained.

(1) On the support surface 104 of the transport belt 103, the plurality of protrusions 106 branched at the distal ends thereof are formed of a metal having higher heat resistance than a resin material. Therefore, even if the heating section 130 heats the medium M to increase the temperature of the transport belt 103, the plurality of protrusions 106 formed on the support surface 104 are less prone to thermal deformation, thereby suppressing the reduction in the intermolecular force to be generated between the plurality of protrusions 106 and the medium M. Accordingly, even if the transport apparatus 100 transports the medium M under a high-temperature environment, the decrease in the transport accuracy of the medium M can be suppressed.

(2) If the medium M transported by the transport belt 103 is heated, the heat may be removed from the medium M to the transport belt 103, with the result that the temperature of the medium M is liable to decrease. In this respect, according to the embodiment described above, the medium M is heated through the heat transfer from the transport belt 103, and hence the heat removal from the medium M to the transport belt 103 is suppressed. Accordingly, the temperature decrease of the medium M can be suppressed.

(3) If the heating section 130 heats the transport belt 103 while being in contact with the transport belt 103, the circulating transport belt 103 and the heating section 130 may slide against each other. Therefore, smooth circulation of the transport belt 103 may be hindered in this case, with the result that the transport accuracy may be decreased. To address this problem, the transport belt 103 is heated through the radiation of infrared rays. Accordingly, the decrease in the transport accuracy of the medium M due to the sliding of the transport belt 103 and the heating section 130 can be suppressed.

(4) The infrared rays are radiated to the support surface 104 of the transport belt 103 circulating along the path which is a part of the circulation path of the transport belt 103 and does not constitute the transport path, and hence the support surface 104 which subsequently supports the medium M can be heated. Accordingly, the medium M to be subsequently supported by the support surface 104 can be heated efficiently.

(5) The plurality of slits 105 extending along the width direction X are formed in the transport belt 103 along the circulation direction R, thereby suppressing an increase in the rigidity of the transport belt 103. As a result, the transport belt 103 can be caused to circulate smoothly. Therefore, variations in the circulation speed of the transport belt 103 do not easily occur, and hence the decrease in the transport accuracy of the medium can be suppressed.

(6) Gas is sucked via the slits 105 that are open through the support surface 104 located on the transport path of the medium M, and hence the medium M supported on the support surface 104 is attracted onto the support surface 104. Therefore, the separation of the medium M from the support surface 104 is further suppressed, and hence the medium M can be transported in a more stable posture.

(7) The wiping section 140 wipes the support surface 104 of the transport belt 103, thereby being capable of reducing the occurrence of a case in which the soil adhering to the transport belt 103 adheres also to the medium M that is transported by the transport belt 103. Further, the wiping section 140 is formed of a material having a lower elastic modulus than the material for the protrusions 106, thereby being capable of reducing the occurrence of a case in which the wiping section 140 deforms the protrusions 106 when wiping the support surface 104.

(8) The water repellency (liquid repellency) can be enhanced by the microstructure of the support surface 104 of the transport belt 103. Therefore, even if the ink adheres to the support surface 104 of the transport belt 103, the ink can be removed easily by wiping the support surface 104 with the wiping section 140.

(9) The transport belt 103 is formed of a metal, thereby being capable of preventing the occurrence of a case in which the transport belt 103 swells with the solvent component of the ink.

(10) The wiping section 140 is arranged between the suction mechanism 120 and the heating section 130 in the circulation direction R of the transport belt 103, and hence the wiping section 140 can wipe the support surface 104 before the support surface 104 is heated by the heating section 130. Therefore, the ink can be removed from the support surface 104 more easily than in a case where the ink is wiped after the solvent component of the ink adhering to the support surface 104 is evaporated through the heating by the heating section 130.

The embodiment described above may be modified as described below.

The heating section 130 may heat the transport belt 103 without radiating the infrared rays. For example, the heating section 130 may heat the transport belt 103 by blowing hot air toward the transport belt 103. Further, the heating section 130 may be a heating element that is arranged so as to be slidable against the transport belt 103 and transfers heat to the transport belt 103 in contact with the heating section 130.

The heating section 130 may heat the transport belt 103 by radiating the infrared rays to the inner surface of the transport belt 103. Further, the heating section 130 may directly heat the medium M by radiating the infrared rays to the print surface of the medium M that is transported by the transport belt 103.

In order to suppress the temperature decrease of the transport belt 103 and the medium M, the peripheries of the transport belt 103 and the transport path of the medium M may be covered with a heat insulating material.

The suction mechanism 120 may be omitted. Even in this case, the medium M can be attracted/supported with the intermolecular force generated between the plurality of protrusions 106 formed on the support surface 104 and the medium M.

In place of the slits 105, a plurality of through holes may be formed in the transport belt 103, or the support surface 104 may be formed into a mesh pattern. Further, the slits 105 or the through holes need not be formed in the support surface 104.

The material for the transport belt 103 may be a silicone resin.

The support surface 104 may be treated to have water repellency. With this treatment, the ink remains on the support surface 104 easily, and can be removed from the support surface 104 easily even when the wiper 141 is not pressed against the support surface 104.

The wiping section 140 may be omitted.

A slight clearance may be provided between the back surface of the transport belt 103 and the sliding portion 124 of the suction mechanism 120. With this clearance, the suction/attraction force to be exerted on the slits 105 of the transport belt 103 is reduced, but the sliding resistance to be exerted on the transport belt 103 due to the sliding against the sliding portion 124 can be reduced instead.

A drying section that dries the medium M after the printing has been completed may be provided. It is preferred that the drying section be arranged at a position where the drying section faces the medium M that is transported along the transport path between the transport apparatus 100 and the take-up section 40.

The medium M is not limited to the textile, but may be paper. Further, the medium M need not be the elongated medium M to be fed from the roll R1. For example, the medium M may be a sheet of paper.

The ejecting portion 32 (printing head) may be a so-called line head that is longer in the width direction X than all the media M on which printing is to be performed by the printing apparatus 10, and is arranged so as to be fixed in the printing apparatus 10.

In the embodiment described above, the recording agent to be used for printing may be a fluid other than ink (a liquid, a liquid-like substance obtained by dispersing or mixing particles of functional materials in a liquid, a fluid-like substance such as a gel, or a substance containing a solid that is ejectable by being caused to flow as a fluid). For example, recording may be performed by ejecting a liquid-like substance containing a dispersed or dissolved material such as an electrode material or a color material (pixel material) to be used for manufacturing liquid crystal displays, electroluminescence (EL) displays, and surface-emitting displays.

In the embodiment described above, the printing apparatus 10 is not limited to the printer that performs recording by ejecting ink, but may be a non-impact printer such as a laser printer, an LED printer, or a thermal transfer printer (including a dye-sublimation printer), or may be an impact printer such as a dot-matrix printer.

This application claims priority under 35 U.S.C. §119 to Japanese Patent Application No. 2016-037491, filed Feb. 29, 2016. The entire disclosure of Japanese Patent Application No. 2016-037491 is hereby incorporated herein by reference.

What is claimed is:

1. A transport apparatus that transports a medium while heating the medium, the transport apparatus comprising:

a transport belt that has a support surface on which a plurality of protrusions are formed, and transports the medium while attracting the medium with an intermolecular force generated between the plurality of protrusions and the medium; and a heating section for heating the medium transported by the transport belt, wherein the protrusions are formed of a metal.

2. The transport apparatus according to claim 1, wherein the heating section heats the transport belt.

3. The transport apparatus according to claim 2, wherein the heating section radiates infrared rays to the transport belt.

4. The transport apparatus according to claim 3, wherein the heating section radiates the infrared rays to the support surface of the transport belt circulating along a path which is a part of a circulation path of the transport belt and does not constitute a transport path of the medium.

5. A printing apparatus, comprising:

the transport apparatus according to claim 4; and a printing section that performs printing on the medium transported by the transport belt of the transport apparatus.

6. A printing apparatus, comprising:

the transport apparatus according to claim 2; and a printing section that performs printing on the medium transported by the transport belt of the transport apparatus.

7. A printing apparatus, comprising:

the transport apparatus according to claim 3; and a printing section that performs printing on the medium transported by the transport belt of the transport apparatus.

8. The transport apparatus according to claim 1, further comprising a plurality of belt rollers around which the transport belt is looped, wherein the transport belt has slits extending along a width direction of the transport belt, which intersects with a circulation direction of the transport belt, and being formed through the transport belt with intervals secured in the circulation direction.

9. The transport apparatus according to claim 8, further comprising a suction mechanism that is arranged so as to face a transport path of the medium across the transport belt, and sucks gas via the slits.

10. A printing apparatus, comprising:

the transport apparatus according to claim 9; and a printing section that performs printing on the medium transported by the transport belt of the transport apparatus.

11. A printing apparatus, comprising:

the transport apparatus according to claim 8; and a printing section that performs printing on the medium transported by the transport belt of the transport apparatus.

12. The transport apparatus according to claim 1, further comprising a wiping section that wipes the support surface of the transport belt circulating along a path which is a part of a circulation path of the transport belt and does not constitute a transport path of the medium, wherein the wiping section is formed of a material having a lower elastic modulus than a material for the plurality of protrusions.

13. A printing apparatus, comprising:

the transport apparatus according to claim 12; and a printing section that performs printing on the medium transported by the transport belt of the transport apparatus.

14. A printing apparatus, comprising:

the transport apparatus according to claim 1; and a printing section that performs printing on the medium transported by the transport belt of the transport apparatus.

* * * * *